US010731456B2

(12) United States Patent
Hawkinson et al.

(10) Patent No.: US 10,731,456 B2
(45) Date of Patent: Aug. 4, 2020

(54) METHOD FOR WELLBORE RANGING AND PROXIMITY DETECTION

(71) Applicant: Scientific Drilling International, Inc., Houston, TX (US)

(72) Inventors: Benjamin C. Hawkinson, Paso Robles, CA (US); Brian D. Gleason, Atascadero, CA (US)

(73) Assignee: SCIENTIFIC DRILLING INTERNATIONAL, INC., Houston, TX (US)

( * ) Notice: Subject to any disclaimer, the term of this patent is extended or adjusted under 35 U.S.C. 154(b) by 183 days.

(21) Appl. No.: 15/590,834

(22) Filed: May 9, 2017

(65) Prior Publication Data

US 2017/0321539 A1 Nov. 9, 2017

Related U.S. Application Data

(60) Provisional application No. 62/333,661, filed on May 9, 2016.

(51) Int. Cl.

| | |
|---|---|
| ***E21B 47/00*** | (2012.01) |
| ***G01S 13/34*** | (2006.01) |
| ***G01N 24/08*** | (2006.01) |
| ***G01V 3/32*** | (2006.01) |
| ***E21B 47/04*** | (2012.01) |
| ***E21B 47/022*** | (2012.01) |

(52) U.S. Cl.
CPC ..... *E21B 47/022* (2013.01)

(58) Field of Classification Search
CPC ..... E21B 47/022; E21B 47/09; E21B 47/04; G01V 3/32; G01N 24/081; G01S 13/34
See application file for complete search history.

(56) References Cited

U.S. PATENT DOCUMENTS

| | | | | |
|---|---|---|---|---|
| 5,481,105 | A * | 1/1996 | Gold | E21B 43/04 250/265 |
| 6,552,333 | B1 | 4/2003 | Storm et al. | |
| 7,351,982 | B2 | 4/2008 | Hofstetter et al. | |
| 8,912,484 | B2 | 12/2014 | Korkin et al. | |
| 2006/0042792 | A1 | 3/2006 | Connell | |
| 2006/0186328 | A1 * | 8/2006 | Radtke | G01V 5/101 250/268 |
| 2009/0296522 | A1 | 12/2009 | Tang et al. | |

(Continued)

FOREIGN PATENT DOCUMENTS

| | | | |
|---|---|---|---|
| EP | 1732085 | A1 | 12/2006 |
| WO | 2014131132 | A1 | 9/2014 |

(Continued)

OTHER PUBLICATIONS

International Search Report and Written Opinion issued in International Application No. PCT/US2017/031790, dated Jul. 14, 2017 (10 pages).

(Continued)

*Primary Examiner* — Christopher P McAndrew
*Assistant Examiner* — Zannatul Ferdous
(74) *Attorney, Agent, or Firm* — Adolph Locklar

(57) ABSTRACT

The present disclosure provides for a ranging and proximity detection system that includes a radiation source, the radiation source positioned within a first wellbore and a radiation detector positioned within a second wellbore.

100 Claims, 5 Drawing Sheets

(56) References Cited

U.S. PATENT DOCUMENTS

| | | | | |
|---|---|---|---|---|
| 2013/0180780 | A1 | 7/2013 | Chirovsky et al. | |
| 2015/0090871 | A1* | 4/2015 | Chace | E21B 47/0005 250/269.7 |
| 2015/0309191 | A1* | 10/2015 | Saenger | G01T 1/18 250/368 |
| 2016/0024909 | A1* | 1/2016 | Han | E21B 47/1015 166/250.1 |
| 2016/0077234 | A1* | 3/2016 | Zhou | G01V 5/101 702/8 |
| 2016/0273339 | A1* | 9/2016 | Wu | G01V 3/26 |
| 2016/0282153 | A1* | 9/2016 | Hefetz | G01D 11/245 |
| 2017/0090049 | A1* | 3/2017 | Ramsden | G01T 3/06 |
| 2017/0139063 | A1* | 5/2017 | Mickael | G01T 1/2018 |
| 2017/0176632 | A1* | 6/2017 | Manclossi | G01V 5/06 |
| 2019/0085661 | A1* | 3/2019 | Dancer | E21B 7/061 |

FOREIGN PATENT DOCUMENTS

| | | | |
|---|---|---|---|
| WO | 2015073007 | A1 | 5/2015 |
| WO | 2016025238 | A1 | 2/2016 |

OTHER PUBLICATIONS

European Search Report issued in European Application No. 17796701.5, dated Nov. 28, 2019 (9 pages).

* cited by examiner

METHOD FOR WELLBORE RANGING AND PROXIMITY DETECTION

CROSS-REFERENCE TO RELATED APPLICATIONS

This application is a nonprovisional application which claims priority from U.S. provisional application No. 62/333,661, filed May 9, 2016.

TECHNICAL FIELD/FIELD OF THE DISCLOSURE

The present disclosure relates generally to wellbore ranging and proximity detection, specifically the use of a radiation source for wellbore ranging and proximity detection.

BACKGROUND OF THE DISCLOSURE

Knowledge of wellbore placement and surveying is useful for the development of subsurface oil & gas deposits, mining, and geothermal energy development. Accurate knowledge of the position of a wellbore at a measured depth, including inclination and azimuth, may be used to attain the geometric target location of, for example, an oil bearing formation of interest. Additionally, accurate relative placement of a wellbore to a geological zone or formation, or relative to one or more adjacent wellbores, may be useful or necessary for the production of hydrocarbons or geothermal energy, or to ensure that adjacent wellbores do not physically intersect each other.

Traditional wellbore survey techniques utilize sensors including north-finding or rate gyroscopes, magnetometers, and accelerometers to measure azimuth and inclination, with depth resulting from drillpipe depth or wireline depth measurements. With traditional wellbore survey techniques, the resultant positional uncertainty between two or more adjacent wellbores may be too large to determine the distance or direction (relative orientation) between the adjacent wellbores within a desired accuracy or statistical confidence interval. In some instances, magnetic ranging techniques may consist of estimating the distance, orientation, or both the distance and orientation of a wellbore or drilling equipment in that wellbore relative to other wellbores by measuring the magnetic field that is produced either passively from the adjacent wellbore's casing or drillpipe, or by measuring an actively generated magnetic field. In some instances, the use of magnetic ranging techniques may result in decreased relative positional uncertainty between adjacent wellbores compared to traditional wellbore survey techniques.

In splitter wells, two wellbores may share the same conductor pipe. Traditionally, in splitter wells, two smaller casings are installed within the same larger conductor. The smaller casings may be in proximity to each other and in certain cases, touching. It is desirable that an exit from one casing, such as, for instance, by drilling out of the shoe or setting a whipstock, does not result in a collision with the other casing. Because both wellbores are cased, the use of magnetic ranging techniques may result in inaccurate results.

When blind drilling, conductor pipes are driven, for instance, from offshore platforms; the position of the bores relative to each other may not be known or not known to a desired accuracy. It is desirable that the bores not intercept each other. Like in splitter wells, the use of magnetic ranging techniques may result in inaccurate results. Thus, recovery of conductors may prove difficult because the blind-drilled bores may be viewed as undrillable due to anti-collision rules.

SUMMARY

The present disclosure provides for a ranging and proximity detection system that includes a radiation source, the radiation source positioned within a first wellbore and a radiation detector positioned within a second wellbore.

A method includes positioning a radiation source within a first wellbore, positioning a radiation detector within a second wellbore, and detecting radiation emitted from the radiation source with the radiation detector.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
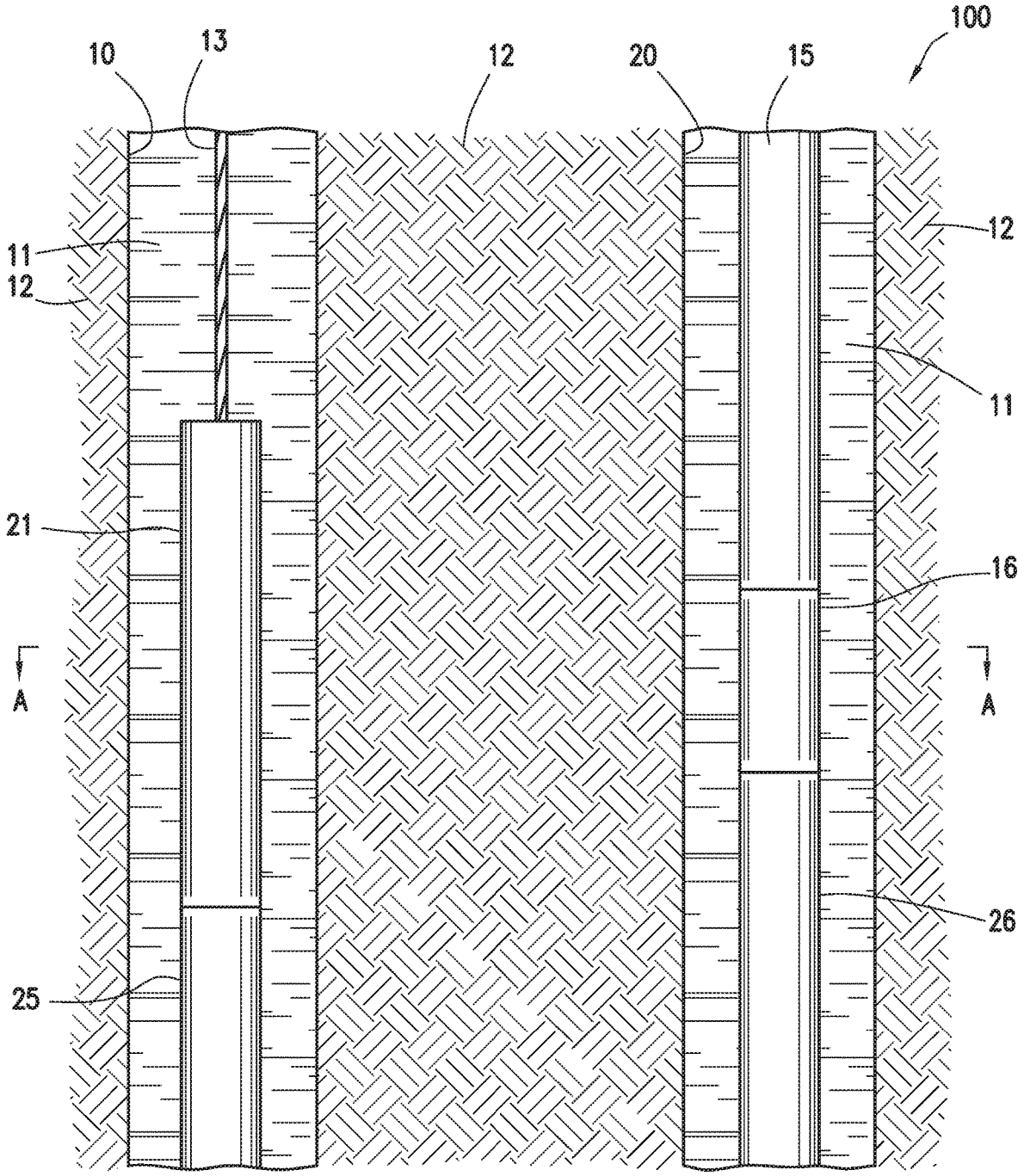
FIG. 1 is a schematic representation of a wellbore ranging and proximity detection system consistent with at least one embodiment of the present disclosure.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship.

As shown in FIG. 1, the present disclosure is directed in certain embodiments to wellbore ranging and proximity system 100. Ranging and proximity system 100 may include radiation source 14 (as shown in FIGS. 2-9) within radiation source assembly 21 positioned in first wellbore 10. Radiation source assembly 21 may be included as part of a downhole assembly such as, for example and without limitation, a wireline assembly, tool string, drill string, casing string, or other downhole tool. In some embodiments, radiation source assembly 21 may be mechanically coupled to upper source connection 13 and lower source connector 25.

Upper source connection 13 and lower source connector 25 may include, for example and without limitation, one or more of a wireline, wireline tool, BHA component, drill string, tool string, casing string, or other downhole tool. In addition, lower source connector 25 may include drill pipe, BHA, wireline tool, or wireline.

As further shown in FIG. 1, wellbore ranging and proximity system 100 may include radiation detector 17 (as shown in FIGS. 2-9) within radiation detector assembly 16 positioned in second wellbore 20. Radiation detector assembly 16 may be included as part of a downhole assembly such as, for example and without limitation, a wireline assembly, tool string, drill string, casing string, or other downhole tool. Radiation detector assembly 16 may be mechanically coupled to upper detector connection 15 and lower detector connector 26. Upper detector connection 15 and lower detector connector 26 may be, for example, drill pipe, a BHA component, wireline, or wireline tool. Radiation detector 17 may be configured to detect radiation emitted from radiation source 14 located within first wellbore 10. In certain embodiments, one or both of first wellbore 10 and second wellbore 20 may be lined with steel casing. In some embodiments, first wellbore 10 and second wellbore 20 may be formed within surrounding formation 12. In other embodiments, first wellbore 10 and second wellbore 20 may be located within different formations. As further shown in FIG. 1, first wellbore 10 and second wellbore 20 may include borehole fluid 11.

Radiation source 14 may be a natural or artificial source of one or more forms of radiation including ionizing radiation such as gamma radiation or neutron radiation. In some embodiments, radiation source 14 may include a natural radiation source such as a radionuclide sample such that radioactive decay of the radionuclide sample causes emission of the desired radiation. In some embodiments, radiation source 14 may be selected such that the radiation emitted by radiation source 14 is in a different spectrum compared to background radiation that may be present in first wellbore 10, second wellbore 20, or surrounding formation 12. In some embodiments, for example and without limitation, radiation source 14 may include a natural gamma radiation source such as, for example and without limitation, a sample of Cesium-137. In other embodiments, radiation source 14 may include a neutron source. In some embodiments, the neutron source may include, for example and without limitation, a natural neutron source including a sample of a nuclide such as Amercium-241 Beryllium or Californium-252. In some embodiments, the neutron source may include an accelerator-type neutron source such as, for example and without limitation, a pulsed neutron generator. In some such embodiments, radiation source 14 may include a neutron-porosity tool that includes such a pulsed neutron generator. The accelerator-type neutron source may, for example and without limitation, pulse neutron radiation in accordance with a predefined schedule or as commanded from the surface or a downhole controller. In some embodiments, radiation source assembly 21 may contain both a neutron source and a gamma radiation source. In some embodiments, radiation source assembly 21 may include more than one natural gamma radiation source, more than one neutron source, or both.

Radiation detector 17 may include one or more sensors for detecting the radiation emitted by radiation source 14 including, for example and without limitation, one or more gamma radiation detectors, neutron detectors, or both. In some embodiments, radiation detector 17 may detect the overall amount of radiation incident on radiation detector 17 over an interval of time. In some embodiments, radiation detector 17 may be configured to measure the amount of incident radiation detected in different spectral bands over an interval of time. In some embodiments, radiation detector 17 may include a gamma radiation detector such as, for example and without limitation, a gas-discharge counter such as a Geiger-Muller tube or a scintillation detector such as a photomultiplier tube, photodiode, or silicon photomultiplier and sodium-iodide (NaI), bismuth germinate (BGO), Lanthanum Bromide (LaBr), or Cerium Bromide (CeBr) scintillator. In some embodiments, gamma detectors may be used to detect gamma radiation from a gamma radiation source in radiation source 14 and/or from radiation from neutron-activated formation or wellbore fluids resulting from neutron radiation from a neutron source of radiation source 14.

In some embodiments, radiation detector 17 may include a neutron detector such as, for example and without limitation, a helium-3 detector. In some embodiments, neutron detectors may be used to detect neutron radiation from a neutron radiation source in radiation source 14 and/or from neutron-activated borehole or formation neutrons.

Figure 6:
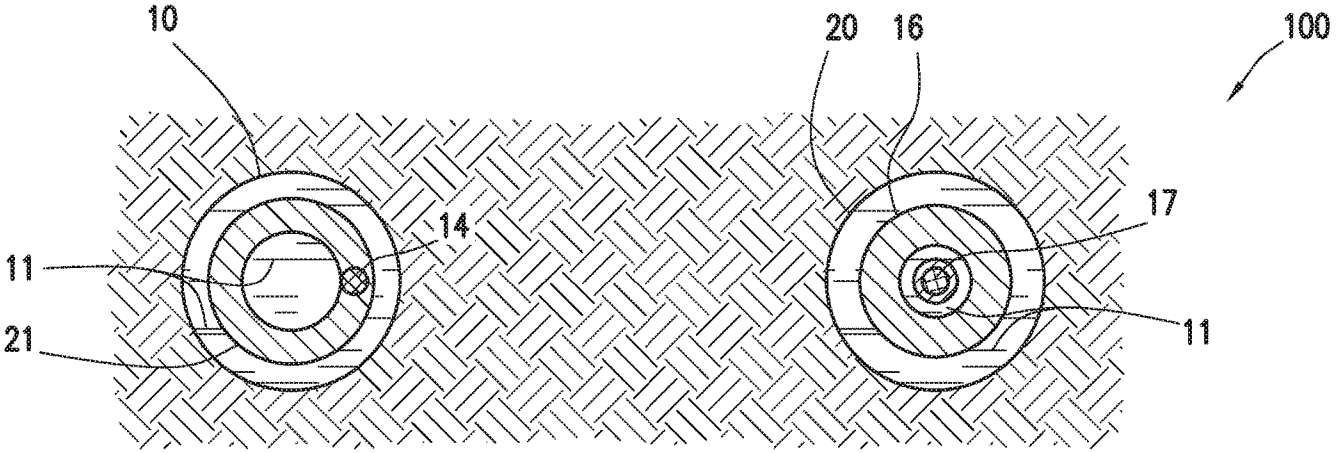
FIG. 6 is a cross-section of FIG. 1 cut along AA consistent with at least one embodiment of the present disclosure.
Figure 7:
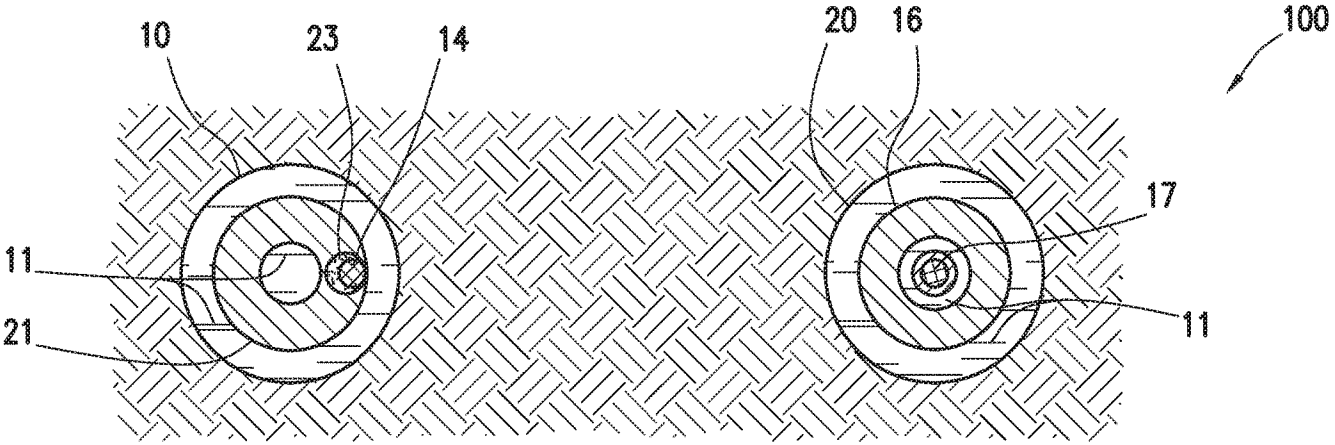
FIG. 7 is a cross-section of FIG. 1 cut along AA consistent with at least one embodiment of the present disclosure.
Figure 8:
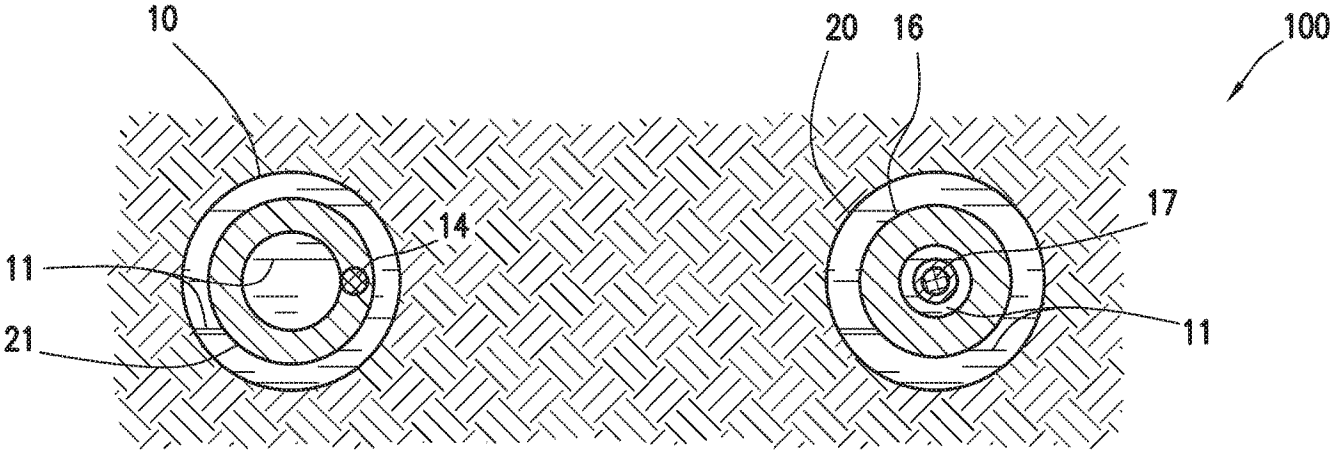
FIG. 8 is a cross-section of FIG. 1 cut along AA consistent with at least one embodiment of the present disclosure.
Figure 9:
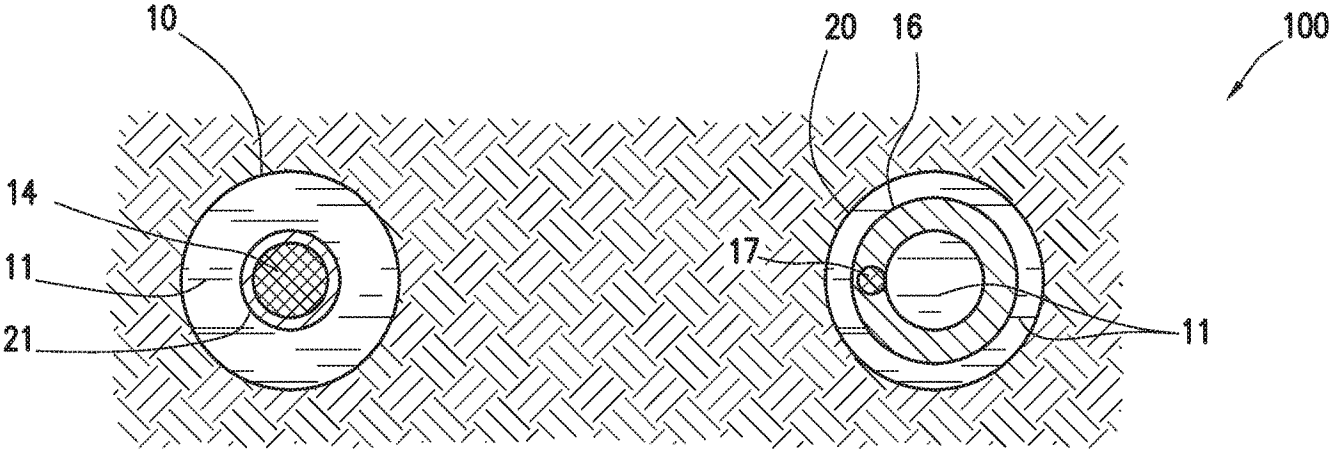
FIG. 9 is a cross-section of FIG. 1 cut along AA consistent with at least one embodiment of the present disclosure.

In some embodiments, as shown in FIGS. 2-5 and 9, radiation source 14, may be configured to emit radiation with equal or near equal intensity in all directions radially from first wellbore 10. In other embodiments, such as shown in FIGS. 6-8, radiation source 14 may be configured to emit radiation in a selected designated radial direction from radiation source assembly 21. In certain embodiments, during operation, radiation source assembly 21 may be rotated such that radiation source 14 presents at different positions relative to first wellbore 10 such that the direction between radiation source 14 and second wellbore 20 may be determined.

In some embodiments, radiation source 14 may be radially shielded in first wellbore 10 such that radiation emitted by radiation source 14 is emitted in a designated radial direction from first wellbore 10. In some embodiments, radiation source 14 may be partially shielded within radiation source assembly 21 or by the configuration of radiation source assembly 21 itself. Shielding may, for example and without limitation, reduce the amount of radiation from radiation source 14 that exits first wellbore 10 in radial directions other than the designated radial direction. For example, in some embodiments, radiation source assembly 21 may be configured such that the density and/or width of components of radiation source assembly 21 and/or additional shielding included in radiation source assembly 21 about radiation source 14 is not uniform about the radius of radiation source assembly 21 or the radius of first wellbore 10 such that radiation source 14 is selectively partially shielded from emitting gamma radiation or neutron radiation. Where radiation source 14 includes a neutron source, the radial shielding may be accomplished by increasing or decreasing the amount of atomically light nuclei about the radius of radiation source 14, radiation source assembly 21, or the radius of first wellbore 10.

For example, as depicted in FIGS. 6-8, radiation source assembly 21 may be a tubular with radiation source 14 positioned within the wall of the tubular. In some embodiments, as depicted in FIG. 6, where radiation source 14 includes a gamma radiation source, selective azimuthal emission may be accomplished by partially shielding radiation source 14 using components of radiation source assembly 21. In the embodiment shown in FIG. 6, for example, partial shielding of radiation source 14 is accomplished by offsetting radiation source 14 from the centerline of first wellbore 10 such that gamma radiation from radiation source 14 passes through additional borehole fluid 11 and components of radiation source assembly 21 in certain directions to exit first wellbore 10. In the embodiment shown in FIG. 8, where radiation source 14 includes a neutron source, shielding may be accomplished, for example, by offsetting the location of radiation source 14 from the centerline of first wellbore 10. Because radiation source 14 is offset, the amount of borehole fluid 11 between radiation source 14 and first wellbore 10 varies radially relative to radiation source 14. Atomically light nuclei of the water or hydrocarbons within borehole fluid 11 surrounding radiation source 14 may thereby variably radially shield neutron radiation from radiation source 14 from exiting first wellbore 10, resulting in radial emission of radiation source 14.

In some embodiments, such as shown in FIG. 7, radiation source assembly 21 may include radiation source shielding 23 such as tungsten or a similar high-density material, between radiation source 14 and the intended radial direction for shielding such that the thickness or density of radiation source shielding 23 is lowest in the desired direction for radial emission of radiation source 14.

In some embodiments, as depicted in FIGS. 2, 3, and 6-9, radiation detector assembly 16 may include radiation detector 17 positioned in a single location within radiation detector assembly 16. In some embodiments, as depicted in FIGS. 6-8, radiation detector 17 may be sensitive to radiation from all directions equally or nearly equally within second wellbore 20. Such a radiation detector 17 may be used with radiation source 14 configured to emit radiation in a selected designated radial direction from radiation source assembly 21.

In some embodiments, such as depicted in FIGS. 2-5, and 9, radiation detector 17 may be configured such that radiation detector 17 is selectively more sensitive to radiation entering radiation detector 17 in a selected azimuthal direction to, for example and without limitation, determine the direction relative to second wellbore 20 from which the radiation from radiation source 14 enters second wellbore 20. Such an azimuthally sensitive radiation detector 17 may be used with radiation source 14 that emits radiation with equal or near equal intensity in all directions. In certain embodiments, during operation, radiation detector assembly 16 may be rotated such that radiation detector 17 presents at different positions relative to radiation source 14 such that the direction between radiation source 14 and second wellbore 20 may be determined.

In some embodiments, radiation detector 17 may be made azimuthally sensitive by partial shielding about radiation detector 17 within radiation detector assembly 16 or by the configuration of radiation detector assembly 16 itself. Shielding may, for example and without limitation, reduce the amount of radiation from radiation source 14 that reaches radiation detector 17 in selected radial directions. For example, in some embodiments, radiation detector assembly 16 may be configured such that the density and/or width of components of radiation detector assembly 16 and/or additional shielding included in radiation detector assembly 16 about radiation detector 17 is not uniform about the radius of radiation detector assembly 16 or the radius of second wellbore 20 such that radiation detector 17 is selectively partially shielded from gamma radiation or neutron radiation. Where radiation detector 17 includes a neutron detector, the radial shielding may be accomplished by increasing or decreasing the amount of atomically light nuclei about the radius of radiation detector 17 assembly 16 or the radius of second wellbore 20.

Figure 2:
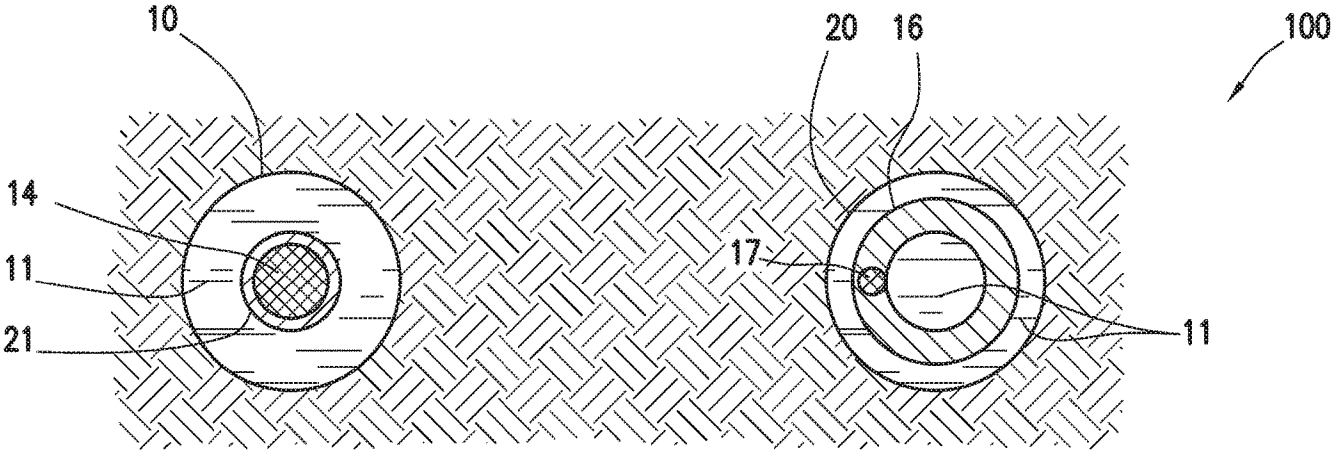
FIG. 2 is a cross-section of FIG. 1 cut along AA consistent with at least one embodiment of the present disclosure.

For example, as shown in FIGS. 2, 4, 5, and 9, radiation detector assembly 16 may be a tubular with azimuthally sensitive radiation detector 17 within the wall of the tubular. In some embodiments, as depicted in FIG. 2, where radiation detector 17 includes a gamma detector, azimuthal sensitivity may be accomplished by partially shielding radiation detector 17 using components of radiation detector assembly 16. In the embodiment shown in FIG. 2, for example, partial shielding of radiation detector 17 is accomplished by offsetting radiation detector 17 from the centerline of the wellbore such that gamma radiation passes through additional borehole fluid 11 and components of radiation detector assembly 16 in certain directions to reach radiation detector 17. In the embodiment shown in FIG. 9, where radiation detector 17 includes a neutron detector, shielding may be accomplished, for example, by offsetting the location of radiation detector 17 from the centerline of second wellbore 20. Because radiation detector 17 is offset, the amount of borehole fluid 11 between radiation detector 17 and second wellbore 20 varies radially relative to radiation detector 17. Atomically light nuclei of the water or hydrocarbons within borehole fluid 11 surrounding radiation detector 17 may thereby variably radially shield neutron radiation from reaching radiation detector 17, resulting in azimuthal sensitivity of radiation detector 17.

Figure 3:
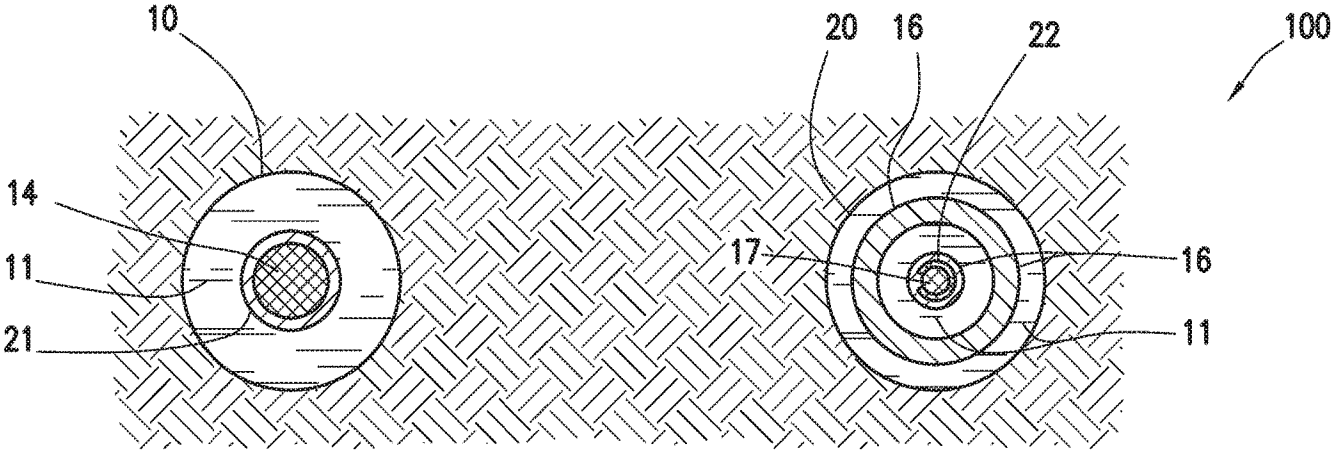
FIG. 3 is a cross-section of FIG. 1 cut along AA consistent with at least one embodiment of the present disclosure.

In other embodiments, as shown in FIG. 3, radiation detector 17 may be made azimuthally sensitive by positioning radiation detector shielding 22 such as tungsten or a similar high-density material, between radiation detector 17 and the intended radial direction for shielding such that the thickness or density of radiation detector shielding 22 is lowest in the desired direction for azimuthal sensitivity of radiation detector 17.

Figure 4:
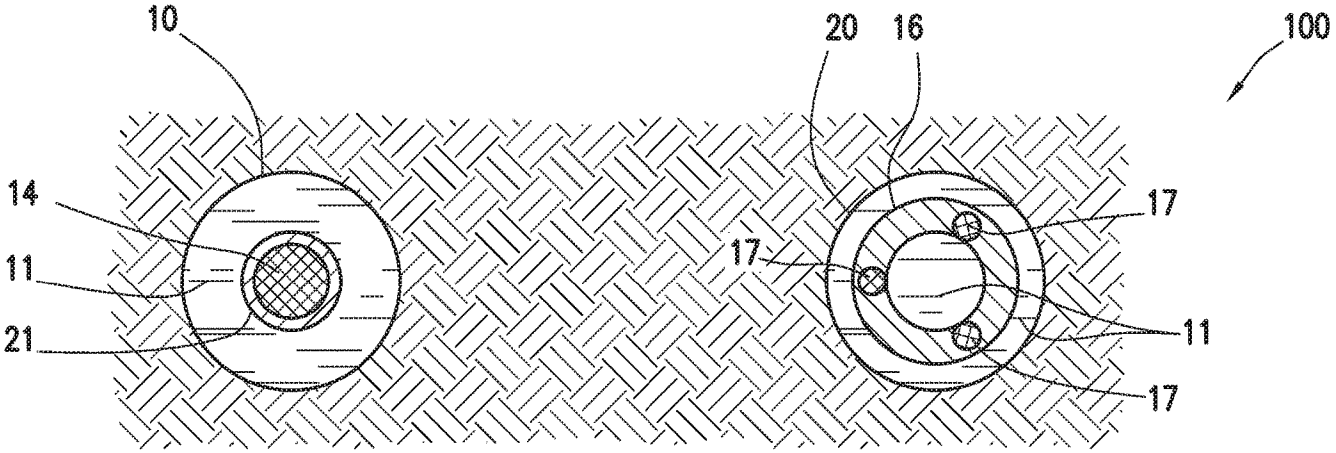
FIG. 4 is a cross-section of FIG. 1 cut along AA consistent with at least one embodiment of the present disclosure.
Figure 5:
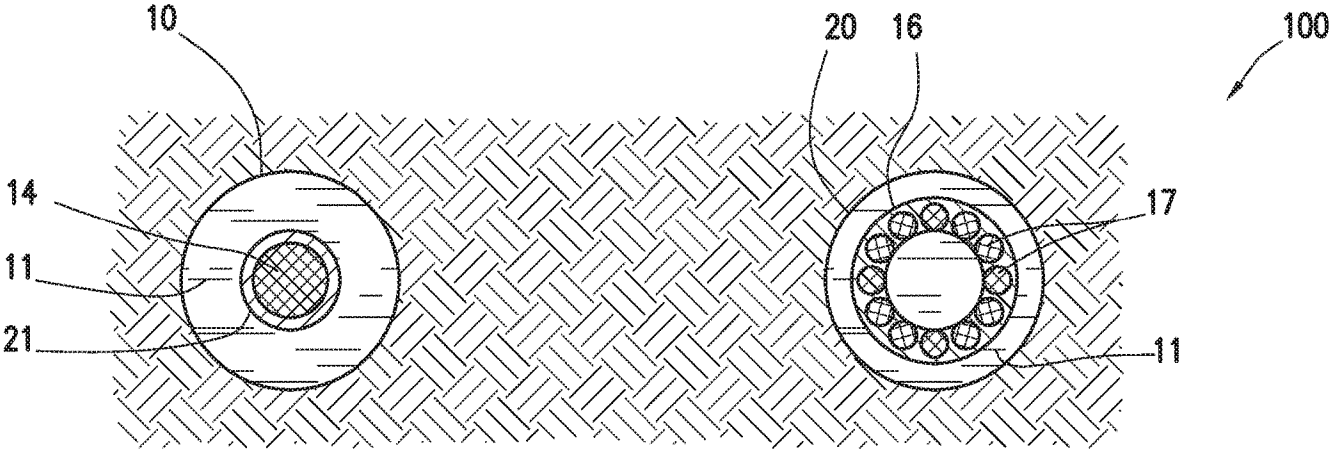
FIG. 5 is a cross-section of FIG. 1 cut along AA consistent with at least one embodiment of the present disclosure.

In other embodiments, as depicted in FIGS. 4 and 5, radiation detector assembly 16 may include multiple radiation detectors 17 arranged radially within radiation detector assembly 16. In some embodiments, such as depicted in FIGS. 4 and 5, radiation detector assembly 16 may detect radiation in all directions inside second wellbore 20 using multiple azimuthally sensitive radiation detectors 17. In certain embodiments, radiation detector assembly 16 may include between 3 and 20 radiation detectors 17. In certain embodiments, determination of the direction and range to first wellbore 10 may not require rotation of radiation detector assembly 16. Instead, radiation measurements made by each radiation detector 17 may be compared to determine the direction and range to first wellbore 10.

For the radiation emitted from radiation source 14 in first wellbore 10 to be detected by radiation detector 17 in second wellbore 20, radiation source 14 and radiation detector 17 may be depth aligned. Depth alignment may be accomplished by deploying radiation source 14 at a depth that minimizes the radial distance between radiation source 14 and radiation detector 17. In two adjacent vertical wellbores, the depth alignment may be accomplished by lowering radiation source 14 and radiation detector 17 so that radiation source 14 and radiation detector 17 are at approximately the same vertical depth. For nominally vertical wellbores, depths for alignment may be generally known based on prior wellbore surveys and may be predetermined before deploying radiation source 14 and radiation detector 17. In other embodiments, such as in deviated or horizontal wellbores, the depth of radiation source 14 or radiation detector 17 may be varied until the magnitude of radiation detected by radiation detector 17 is sufficiently larger than background radiation or has sufficient performance statistics to begin the remainder of the nuclear ranging process to determine the direction between the wellbores. In some embodiments, if sufficient radiation magnitude is not detected by radiation detector 17 during the depth alignment process, varying of radiation source 14 or radiation detector 17 may be used to determine the minimum distance between the two wellbores at either the depth of radiation source 14 or radiation detector 17.

In some embodiments, once radiation source 14 and radiation detector 17 are depth aligned, one or more measurements may be taken by radiation detector 17. If radiation detector 17 is azimuthally sensitive, one or more radiation detector measurements may be obtained at different radial orientations by rotating the detector about its roll axis. If radiation source 14 is radially shielded, one or more radiation detector measurements may be obtained at different radial orientations by rotating radiation source 14 about its roll axis. At each of the one or more radial orientations, the radial orientation of the azimuthally-sensitive radiation detector 17 and/or the radially-shielded radiation source 14 is determined by measuring a gyroscopic azimuth, gyro toolface, high-side toolface using accelerometers, and/or a magnetic azimuth or toolface using sensors associated with radiation detector 17 and/or radiation source 14.

In some circumstances the magnetic azimuth and magnetic toolface may be corrupted due to the close proximity of the two wellbores. A response function or mapping may be created between the one or more radiation detector 17 measurements and the corresponding roll-axis measurements. The response function may be used as an indicator of the direction to a target. For example, the roll-axis orientation corresponding to the highest detected radiation magnitude may be an indicator of the heading from one wellbore to the other wellbore. In some embodiments, the response function may be interpolated or used in conjunction with a simulated or mathematical response model to obtain better resolution or accuracy on the relative heading. In other embodiments, the response function may be used with a simulated or mathematical response model to also estimate the distance to the target. In some embodiments, radiation detector 17 and roll axis measurements may be taken while either the radially-shielded radiation source and/or the azimuthally sensitive radiation detector are continuously rotated and then dynamically binned into sectored azimuthal measurements. In other embodiments, the measurements may be obtained at discrete roll stationary axis orientations.

In some embodiments, azimuthally-sensitive radiation detector 17 and/or radially-shielded radiation source 14 may be oriented downhole to other drilling equipment, including but not limited to, a drilling assembly, whipstock, wireline or memory gyro, or a gyro MWD system. In some embodiments, azimuthally-sensitive radiation detector 17 and/or radially-shielded radiation source 14 may be deployed in a BHA that may be connected to a drilling or whipstock assembly. In some embodiments azimuthally-sensitive radiation detector 17 and/or the radially-shielded radiation source 14 may be deployed, mechanized platforms that allow for azimuthally-sensitive radiation detector 17 and/or the radially-shielded radiation source 14 to be rotated downhole.

In certain embodiments, data regarding the direction of and magnitude readings from radiation detector 17 may be communicated by radiation detector 17 to surface by telemetry methods. In certain embodiments, data regarding the direction of the radially-shielded radiation source may be communicated from radiation source 14 to surface by telemetry methods. Telemetry methods may include, but are not limited to, electromagnetic telemetry, acoustic telemetry, mud pulse telemetry, wired pipe, or wireline communications.

In some embodiments, the influence of background radiation may be mapped and influence removed by turning radiation source 14 off, then performing the same measurements with radiation source 14 on. The orientation corresponding to the highest radiation magnitude may be an indicator of the heading from the target well toward the offset wellbore.

As described above, in some embodiments, instead of rotating a focused radiation detector, such as an azimuthally-focused radiation detector, radiation detector 17 may be displaced from one radial location to another radial location at the same depth in the wellbore, thereby changing the radial distance to the target wellbore and also correspondingly increasing or decreasing the amount of borehole fluid 11 between the radiation detector 17 and radiation source 14. The change in measured radiation at these positions may be a function of the radial proximity to the radiation and the attenuation along a travel path. Thus, by measuring the magnitude of the radiation and combining with the orientation of radiation detector 17 displacements, the direction to first wellbore 10 may be determined.

Certain embodiments of the present disclosure are directed towards a method of using the wellbore ranging and proximity detection system. Radiation source 14 and radiation detector 17 may be positioned in first wellbore 10 and second wellbore 20. In certain embodiments, the position of radiation source 14 in first wellbore 10 and radiation detector 17 in second wellbore 20 may be accomplished using the depth alignment procedure described herein above. In other embodiments, one or both of radiation source 14 and radiation detector 17 are positioned at predetermined positions in first wellbore 10 and second wellbore 20.

Following placement in first wellbore 10, radiation source 14 may be activated, such as for a pulsed neutron generator. Where radiation source 14 is a natural neutron source or a natural gamma source, radiation source 14 may need not be activated. Radiation detector 17 may be activated.

In certain embodiments, as described herein above, radiation source 14 may be rotated. In other embodiments, radiation detector 17 may be rotated. When radiation source 14 or radiation detector 17 are rotated, radiation data may be acquired in a series of orientations. The orientation in which the highest radiation is detected may be considered the direction to the first wellbore. In certain embodiments, neither radiation source 14 nor radiation detector 17 are rotated.

In certain embodiments, once the direction to the first wellbore has been determined, radiation source 14 may be cycled off and on, or removed from the first wellbore. The cycling or removal from the first wellbore of radiation source 14 may be accomplished to confirm that the radiation being detected by the focused radiation detector is from radiation source 14.

Once confirmed, the orientation of radiation detector 17 may be measured by using an azimuth sensor that is configured to measure the sensitive azimuth of the focused radiation detector, for example, a gyroscope, or some other action may be taken, e.g. a whipstock may be set, which may be dependent on the orientation of radiation detector 17. Radiation detector 17 may be coupled to the azimuth sensor.

In certain embodiments, data regarding the direction of radiation detector 17 relative to radiation source 14 may be communicated from radiation detector 17 to the surface by telemetry methods. Telemetry methods may include, but are not limited to, EM transmission, acoustic transmission, or mud pulse.

The foregoing outlines features of several embodiments so that a person of ordinary skill in the art may better understand the aspects of the present disclosure. Such features may be replaced by any one of numerous equivalent alternatives, only some of which are disclosed herein. One of ordinary skill in the art should appreciate that they may readily use the present disclosure as a basis for designing or modifying other processes and structures for carrying out the same purposes and/or achieving the same advantages of the embodiments introduced herein. One of ordinary skill in the art should also realize that such equivalent constructions do not depart from the spirit and scope of the present disclosure and that they may make various changes, substitutions, and alterations herein without departing from the spirit and scope of the present disclosure.

The invention claimed is:

1. A ranging and proximity detection system comprising:

a radiation source, the radiation source positioned within a first wellbore, the radiation source being a source of ionizing radiation; and a radiation detector positioned within a second wellbore, the radiation detector adapted to detect radiation from the radiation source;

wherein the ranging and proximity detection system is adapted to determine the distance, direction, or a combination thereof between the radiation detector and the radiation source.

2. The ranging and proximity detection system of claim 1, wherein the radiation source comprises a gamma radiation source, a neutron source, or a combination thereof.

3. The ranging and proximity detection system of claim 2, wherein the radiation source is a natural gamma radiation source.

4. The ranging and proximity detection system of claim 2, wherein the radiation source is a natural or radionuclide neutron source.

5. The ranging and proximity detection system of claim 2, wherein the radiation source is an accelerator-type neutron source.

6. The ranging and proximity detection system of claim 1, wherein the radiation detector is a helium-3 detector.

7. The ranging and proximity detection system of claim 1, wherein the radiation detector is a gas-discharge counter or a scintillation detector.

8. The ranging and proximity detection system of claim 1, wherein the radiation source is positioned within a radiation source assembly and the radiation detector is positioned within a radiation detector assembly.

9. The ranging and proximity detection system of claim 8, wherein the radiation source, the radiation detector, or both, are shielded.

10. The ranging and proximity detection system of claim 8, wherein the radiation source is adapted to emit radiation with equal or near equal intensity in all directions and the radiation detector is azimuthally sensitive.

11. The ranging and proximity detection system of claim 9, wherein the radiation detector is offset from a centerline of the second wellbore.

12. The ranging and proximity detection system of claim 9, wherein the radiation detector assembly, the radiation source assembly, or both are adapted to be rotated during operation of the radiation detector assembly, the radiation source assembly or both.

13. The ranging and proximity detection system of claim 9, wherein the radiation detector shielding is tungsten or steel.

14. The ranging and proximity detection system of claim 8, comprising a plurality of radiation detectors located within the radiation detector assembly.

15. The ranging and proximity detection system of claim 14, wherein the radiation detector comprises between 3 and 20 azimuthally sensitive radiation detectors.

16. The ranging and proximity detection system of claim 14, wherein the radiation detector assembly does not rotate.

17. The ranging and proximity detection system of claim 8, wherein the radiation source, radiation detector, or both are radially shielded.

18. The ranging and proximity detection system of claim 17, wherein the radiation source is a gamma radiation source and the radiation source is offset from the centerline of the first wellbore or by placing a shield proximate the radiation source.

19. The ranging and proximity detection system of claim 1, wherein the radiation detector is adapted to produce a dynamically-binned measurement, or a manually-positioned measurement.

20. A method comprising:

positioning a radiation source within a first wellbore, the radiation source being a source of ionizing radiation;

positioning a radiation detector within a second wellbore; and detecting radiation emitted from the radiation source with the radiation detector.

21. The method of claim 20, wherein the step of positioning the radiation source comprises:

deploying the radiation source within the first wellbore at a depth that minimizes the radial distance between the radiation source and the radiation detector.

22. The method of claim 20 further comprising positioning the radiation source and the radiation detector at approximately the same vertical depth.

23. The method of claim 20 further comprising positioning the radiation source in the first wellbore and the radiation detector in the second wellbore at a predetermined depth.

24. The method of claim 20 further comprising positioning the radiation source in the first wellbore and positioning the radiation detector in the second wellbore by varying the positions of the radiation source, the radiation detector, or both.

25. The method of claim 20, wherein the step of detecting radiation emitted from the radiation source with the radiation detector further comprises detecting an overall amount of radiation incident on the radiation detector over a time interval or measuring the amount of incident radiation detected by the radiation detector in different spectral bands over a time interval.

26. The method of claim 20, wherein the radiation detector is azimuthally sensitive.

27. The method of claim 26 further comprising after detecting radiation emitted from the radiation source with the radiation detector:

determining the radial orientation of the radiation detector.

28. The method of claim 27, wherein the step of determining the radial orientation of the radiation detector comprises acquiring radiation data from a series of orientations and determining which of the orientations has the largest radiation magnitude.

29. The ranging and proximity detection system of claim 2, wherein the radiation source is adapted to emit radiation in a spectrum different from that of background radiation in the first wellbore, background radiation in the second wellbore, or both.

30. The ranging and proximity detection system of claim 1, wherein the radiation detector comprises a gamma radiation detector, a neutron detector, or a combination thereof.

31. The ranging and proximity detection system of claim 1, wherein the radiation detector is adapted to measure radiation over different spectral bands.

32. The ranging and proximity detection system of claim 1, wherein the radiation source, the radiation detector, or both are radially shielded.

33. The ranging and proximity detection system of claim 1, wherein the radiation source, the radiation detector, or both are azimuthally sensitive.

34. The ranging and proximity detection system of claim 9, wherein the radiation detector, the radiation source, or both are shielded by borehole fluid.

35. The ranging and proximity detection system of claim 9, wherein the radiation shielding is atomically light nuclei material or borehole fluid.

36. The ranging and proximity detection system of claim 9, wherein the radiation source is offset from a centerline of the first wellbore.

37. The ranging and proximity detection system of claim 36, wherein the offset of the radiation source provides shielding using the borehole fluid.

38. The ranging and proximity detection system of claim 11, wherein the offset of the radiation detector provides shielding using the borehole fluid.

39. The ranging and proximity detection system of claim 8, wherein the radiation detector is adapted to detect radiation with equal or near equal intensity in all directions and the radiation source is radially shielded.

40. The method of claim 20, further comprising determining the direction to the first wellbore using the detected radiation.

41. The method of claim 20, further comprising determining the direction to the first wellbore by measuring the detected radiation and orientation of one or more azimuthally sensitive radiation detectors.

42. The method of claim 41, wherein the step of determining the direction to the first wellbore further comprises determining the orientation in which the highest magnitude of radiation is detected.

43. The method of claim 41, wherein the step of determining the direction to the first wellbore further comprises measuring a response function or mapping.

44. The method of claim 41, further comprising changing the amount of borehole fluid between the radiation detector and the radiation source to make the one or more radiation detectors azimuthally sensitive.

45. The method of claim 20, further comprising determining the direction to the second wellbore by measuring the detected radiation and orientation of one or more radially shielded sources.

46. The method of claim 45, wherein the step of determining the direction to the second wellbore further comprises determining the orientation in which the highest magnitude of radiation is detected.

47. The method of claim 45, wherein the step of determining the direction to the second wellbore further comprises measuring a response function or mapping.

48. The method of claim 45, further comprising changing the amount of borehole fluid between the radiation detector and the radiation source to make the one or more radiation sources radially shielded.

49. The method of claim 26, further comprising using gyroscopic azimuth, gyro toolface, high-side toolface, magnetic azimuth, magnetic toolface, or a combination thereof to measure the orientation of the azimuthally sensitive radiation detector.

50. The method of claim 49, further comprising changing the orientation of the radiation source, the radiation detector, or both by rotation.

51. The method of claim 20, further comprising using gyroscopic azimuth, gyro toolface, high-side toolface, magnetic azimuth, magnetic toolface, or a combination thereof to measure the orientation of the radiation source, radiation detector, or combination thereof.

52. The method of claim 51, further comprising changing the orientation of the radiation source, the radiation detector, or both by rotation.

53. The method of claim 26, further comprising measuring the orientation of the azimuthally sensitive radiation detector using an azimuth sensor.

54. The method of claim 20, further comprising determining the distance to the first wellbore using the detected radiation.

55. The method of claim 54, further comprising determining the distance to the first wellbore by measuring a response function or mapping.

56. The method of claim 55, further comprising determining the distance to the first wellbore by using the measured response function with a simulated or mathematical response model.

57. The method of claim 54, further comprising determining distance during the depth alignment process.

58. The method of claim 20, further comprising cycling the radiation source off and on, removing the radiation source from the first wellbore, or both to confirm that detected radiation is from the radiation source.

59. The ranging and proximity detection system of claim 17, wherein the radiation source is a neutron radiation source and the radiation source is offset from the centerline of the first wellbore.

60. The ranging and proximity detection system of claim 17, wherein the radiation source is a neutron radiation source and a shield is positioned proximate the radiation source.

61. The method of claim 20, further comprising setting a whipstock based on the detected radiation.

62. The ranging and proximity detection system of claim 1, wherein the radiation source and radiation detector are depth aligned.

63. The method of claim 24, further comprising varying the depths of the radiation source, radiation detector, or both until magnitude of the detected radiation is larger than background radiation.

64. The method of claim 57, further comprising determining a minimum distance between the two wellbores at either the depth of the of the radiation source or the radiation detector based on the detected radiation.

65. The method of claim 43, further comprising determining the direction to the first wellbore using the response function or mapping.

66. The method of claim 46, further comprising determining the direction to the second wellbore using the response function or mapping.

67. The method of claim 20, wherein when changing the orientation of the radiation source, the radiation detector, or both, the detected radiation is varied by changing the amount of borehole fluid between the radiation detector and radiation source.

68. A ranging and proximity detection system comprising:

a neutron radiation source, the neutron radiation source positioned within a first wellbore; and a gamma radiation detector positioned within a second wellbore, the gamma radiation detector adapted to detect neutron-activated gamma radiation from the formation or neutron-activated gamma radiation from wellbore fluids;

wherein the ranging and proximity detection system is adapted to determine the distance, direction, or a combination thereof between the gamma radiation detector and the neutron radiation source.

69. The ranging and proximity detection system of claim 68, wherein the neutron radiation source is positioned within a radiation source assembly and the gamma radiation detector is positioned within a radiation detector assembly.

70. The ranging and proximity detection system of claim 68, wherein the radiation detector assembly, the radiation source assembly, or both are adapted to be rotated during operation of the radiation detector assembly, the radiation source assembly or both.

71. The ranging and proximity detection system of claim 68, comprising a plurality of gamma radiation detectors located within the radiation detector assembly.

72. The ranging and proximity detection system of claim 71, wherein the plurality of gamma radiation detectors comprises between 3 and 20 azimuthally sensitive gamma radiation detectors.

73. The ranging and proximity detection system of claim 68, wherein the gamma radiation detector is adapted to measure radiation over different spectral bands.

74. The ranging and proximity detection system of claim 68, wherein the neutron radiation source, the gamma radiation detector, or both are radially shielded.

75. The ranging and proximity detection system of claim 68, wherein the neutron radiation source, the gamma radiation detector, or both are azimuthally sensitive.

76. The ranging and proximity detection system of claim 75, wherein the radiation shielding is atomically light nuclei material or borehole fluid.

77. The ranging and proximity detection system of claim 75, wherein the neutron radiation source is offset from a centerline of the first wellbore and the offset provides shielding using the borehole fluid.

78. The ranging and proximity detection system of claim 68, wherein the neutron radiation source and gamma radiation detector are depth aligned.

79. A method comprising:

positioning a neutron radiation source within a first wellbore;

positioning a radiation detector within a second wellbore; and detecting neutron-activated gamma radiation from the formation or neutron-activated gamma radiation from wellbore fluids.

80. The method of claim 79 further comprising detecting neutron radiation emitted from the neutron radiation source using the radiation detector.

81. The method of claim 79, wherein the step of positioning the neutron radiation source comprises:

deploying the neutron radiation source within the first wellbore at a depth that minimizes the radial distance between the neutron radiation source and the radiation detector.

82. The method of claim 79 further comprising positioning the neutron radiation source in the first wellbore and positioning the radiation detector in the second wellbore by varying the positions of the radiation source, the radiation detector, or both.

83. The method of claim 79, wherein the step of detecting radiation emitted from the neutron radiation source with the radiation detector further comprises detecting an overall amount of radiation incident on the radiation detector over a time interval or measuring the amount of incident radiation detected by the radiation detector in different spectral bands over a time interval.

84. The method of claim 83 further comprising detecting radiation emitted from the neutron radiation source with the radiation detector and determining the radial orientation of the radiation detector.

85. The method of claim 84, wherein the step of determining the radial orientation of the radiation detector comprises acquiring radiation data from a series of orientations and determining which of the orientations has the largest radiation magnitude.

86. The method of claim 79, further comprising determining the direction to the first wellbore from the second wellbore using the detected radiation.

87. The method of claim 79, wherein the radiation detector comprises one or more azimuthally sensitive radiation detectors, further comprising determining the direction to the first wellbore from the second wellbore by measuring the detected radiation and orientation of the one or more azimuthally sensitive radiation detectors.

88. The method of claim 87, wherein the step of determining the direction to the first wellbore further comprises determining the orientation in which the highest magnitude of radiation is detected by the one or more azimuthally sensitive radiation detectors.

89. The method of claim 87, wherein the step of determining the direction to the first wellbore further comprises measuring a response function or mapping.

90. The method of claim 87 further comprising changing the amount of borehole fluid between the one or more azimuthally sensitive radiation detectors and the neutron radiation source to make the one or more azimuthally sensitive radiation detectors azimuthally sensitive.

91. The method of claim 79, wherein the neutron radiation source is a radially shielded source, further comprising determining the direction to the second wellbore from the first wellbore by measuring the detected radiation and orientation of the radially shielded source.

92. The method of claim 91, wherein the step of determining the direction to the second wellbore from the first wellbore further comprises determining the orientation in which the highest magnitude of radiation is detected by the radiation detector.

93. The method of claim 92, wherein the step of determining the direction to the second wellbore from the first wellbore further comprises measuring a response function or mapping.

94. The method of claim 92, further comprising changing the amount of borehole fluid between the radiation detector and the radially shielded source to make the one or more radially shielded source radially shielded.

95. The method of claim 79, further comprising using gyroscopic azimuth, gyro toolface, high-side toolface, magnetic azimuth, magnetic toolface, or a combination thereof to measure the orientation of the radiation detector, the neutron radiation source, or combination thereof.

96. The method of claim 95, further comprising changing the radial orientation of the neutron radiation source, the radiation detector, or both.

97. The method of claim 79, further comprising determining the distance to the first wellbore from the second wellbore using the detected radiation.

98. The method of claim 97, further comprising determining the distance to the first wellbore from the second wellbore by measuring a response function or mapping.

99. The method of claim 98, further comprising determining the distance to the first wellbore from the second wellbore by using the measured response function with a simulated or mathematical response model.

100. The method of claim 79, wherein when changing the orientation of the neutron radiation source, the radiation detector, or both, the detected radiation is varied by changing the amount of borehole fluid between the radiation detector and neutron radiation source.

* * * * *